US006464594B1

(12) United States Patent
Canna et al.

(10) Patent No.: US 6,464,594 B1
(45) Date of Patent: Oct. 15, 2002

(54) RELEASABLE AND SECURABLE MOBILE

(75) Inventors: John Canna, Orchard Park; Robert Sonner, South Whales, both of NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/855,023

(22) Filed: May 15, 2001

(51) Int. Cl.[7] ..... A63G 9/16
(52) U.S. Cl. ..... 472/119; 446/227; 40/411
(58) Field of Search ..... 446/227, 242, 446/265; 40/411, 617; 472/118, 119, 125

(56) References Cited

U.S. PATENT DOCUMENTS

| | | | | |
|---|---|---|---|---|
| 3,919,795 A | * | 11/1975 | Van Horne Jinivisian et al. | 40/411 |
| 3,978,610 A | | 9/1976 | Stubbmann | |
| 4,640,034 A | | 2/1987 | Zisholtz | |
| 4,642,859 A | | 2/1987 | Kaiser | |
| 4,722,713 A | | 2/1988 | Williams et al. | |
| 4,904,220 A | * | 2/1990 | Williams et al. | 446/227 |
| 4,984,380 A | | 1/1991 | Anderson | |
| 5,054,170 A | | 10/1991 | Otrusina | |
| 5,352,145 A | | 10/1994 | Raiffe et al. | |
| 5,370,570 A | | 12/1994 | Harris | |
| 5,620,274 A | | 4/1997 | Wear | |
| 5,672,088 A | | 9/1997 | Chininis | |
| 5,702,039 A | | 12/1997 | Olaiz | |
| 5,703,564 A | | 12/1997 | Begum et al. | |
| 5,797,785 A | | 8/1998 | Silberstein | |
| 5,803,817 A | | 9/1998 | Stern | |
| 5,951,360 A | | 9/1999 | Fearon et al. | |
| 6,027,409 A | | 2/2000 | Favorito et al. | |
| 6,068,285 A | | 5/2000 | Jackson et al. | |
| 6,068,535 A | | 5/2000 | Hoyt | |
| 6,178,978 B1 | * | 1/2001 | Rieber | 135/147 |

FOREIGN PATENT DOCUMENTS

| | | |
|---|---|---|
| GB | 2 249 423 A | 5/1992 |
| WO | WO 02/05917 | 1/2002 |

OTHER PUBLICATIONS

"PreToy Fair 2001," p. 31, Item Nos. 79436, 79613, 79614, and 79595.

"Toy Fair 2000," p. 151, Item No. 79560.

"Toy Fair '99," p. 136, Item Nos. 79534 and 79532.

* cited by examiner

*Primary Examiner*—Kien T. Nguyen
(74) *Attorney, Agent, or Firm*—Morgan, Lewis & Bockius LLP

(57) ABSTRACT

A child's entertainment device can include a mobile/entertainment member that has a connector structure that can engage a receiving member located on a child support device. The connector structure can be formed as a button-like protuberance that engages the receiving member, which can be formed as a U-shaped aperture. The button-like protuberance is thus lockable in the U-shaped receiving member at a predetermined position while rotatable with the respect to the receiving member. In addition, the entertainment member can be removed from the receiving member by applying a force to it and moving the button-like protuberance past a slightly narrower portion and out of the U-shaped aperture. When the entertainment member is attached to the receiving member, the mobile/entertainment member and attached soft toys can spin and entertain a child. The mobile may be attached to a child support device such as a child's cradle, bassinet, swing, bouncer, or car seat, etc.

36 Claims, 6 Drawing Sheets

RELEASABLE AND SECURABLE MOBILE

FIELD OF THE INVENTION

The invention relates to an entertainment device that includes a child support with an entertainment member attached to the child support. The entertainment member is preferably releasable and securable to a cradle, bassinet, swing, bouncer, car seat, or other child support device. More particularly, the invention is directed to a child's mobile that rotates freely from a portion of a cradle, bassinet, swing, bouncer, car seat, etc., and is quickly and easily releasable from and securable to the cradle, bassinet, swing, car seat, etc.

BACKGROUND OF THE INVENTION

Conventional mobiles for children typically are secured to cribs and play pens or suspended from the ceiling above a location where a child lays or sits. These mobiles often have elaborate mechanisms for attachment to the crib or ceiling and may have toys or teething objects hanging from long strings extending from the ends of the mobile arms. A string or rod often suspends these mobiles so that the mobile can freely rotate as directed by a child. Some conventional mobiles are motorized and can rotate in a predetermined direction for visual stimulation.

The somewhat complicated assembly for attaching conventional mobiles to a supporting structure results in an increase in manufacturing cost and decreases the devices' appeal to customers. Furthermore, some conventional mobiles require a significant amount of clearance space between their attachment to a supporting structure and the mobile itself, making the conventional mobile inconvenient for use with child supports designed for smaller spaces. Additional clearance space is also required between the bottom of the mobile and the child, thereby further limiting the options where conventional mobiles can be placed.

Conventional cradles, bassinets, swings, bouncers, car seats, or other child support devices are designed to restrain the child and provide a safe environment for the child to rock, sleep, swing, bounce, and motor along. The sensory stimulation from rocking in a cradle, swinging in a seat, jumping in a bouncer, or motoring in an automobile can be beneficial to the child's development. However, after extended periods of time restrained in the child support device a child can become bored and irritable. Therefore, it is desirable to provide an easily securable entertainment device that can be quickly attached to a child support for the child's amusement, and can be detached easily for facilitating removal of the child from the child support.

SUMMARY OF THE INVENTION

In the invention, an entertainment device can include an entertainment member, such as a freely rotatable soft mobile, that can be quickly and easily attached to and removed from a child support device. Thus, the mobile can be attached so that a child located in the child support device can play with the mobile while seated, and can be easily detached from the child support device to facilitate removing the child from the child support. The entertainment member can include connection means that has a low profile such that the entertainment member can be located in relatively small spaces, such as between a swing and its overhead support member.

To achieve these and other advantages and in accordance with the purpose of the invention, as embodied and broadly described, the invention provides an entertainment device that can include a child support device having a receiving member and an entertainment member, e.g., a child's mobile, which includes a connector structure for quick and easy attachment to the receiving member on the child support device.

In another aspect of the invention, the entertainment device can include an entertainment member that is releasably attached to a child support device, for example a cradle, bassinet, swing, bouncer, or car seat. The child support device can have an upper structure located above the child when the child is positioned within the child support device. A receiving member can be attached to the upper structure of the child support device and be engagable with a connector structure on the entertainment member. The receiving member can be releasably securable with the connector structure, and configured to prevent the connector structure from disengaging from the receiving member while allowing the connector structure to freely rotate within the receiving member. The connector structure can be slid past the narrowest aperture of the receiving member until it snaps into or out of a locked position on the receiving member to secure or release the entertainment member with the receiving member.

In another aspect of the invention, the entertainment device can include means for connecting a rotary entertainment member with a connection structure such that the rotary entertainment member is prevented from translating with respect to the connection structure and can freely rotate within and be selectively removable from the connection structure.

In yet another aspect of the invention, a method for connecting a rotary entertainment member to another structure is disclosed. The method can include providing a rotary entertainment member with a connector and securing it to a connection structure while permitting the connector to freely rotate with respect to the connection structure.

It is to be understood that the foregoing general description and the following detailed description are exemplary and explanatory and are intended to provide further explanation of the invention as claimed.

BRIEF DESCRIPTION OF THE DRAWINGS

The accompanying drawings, which are included to provide further understanding of the invention and are incorporated in and constitute a part of the specification, illustrate preferred embodiments of the invention and together with the detailed description below serve to explain the principles of the invention. In the drawings.

DETAILED DESCRIPTION OF THE PREFERRED EMBODIMENTS

Reference will now be made in detail to the present preferred embodiments of the invention, examples of which are illustrated in the accompanying drawings.

Figure 1A:
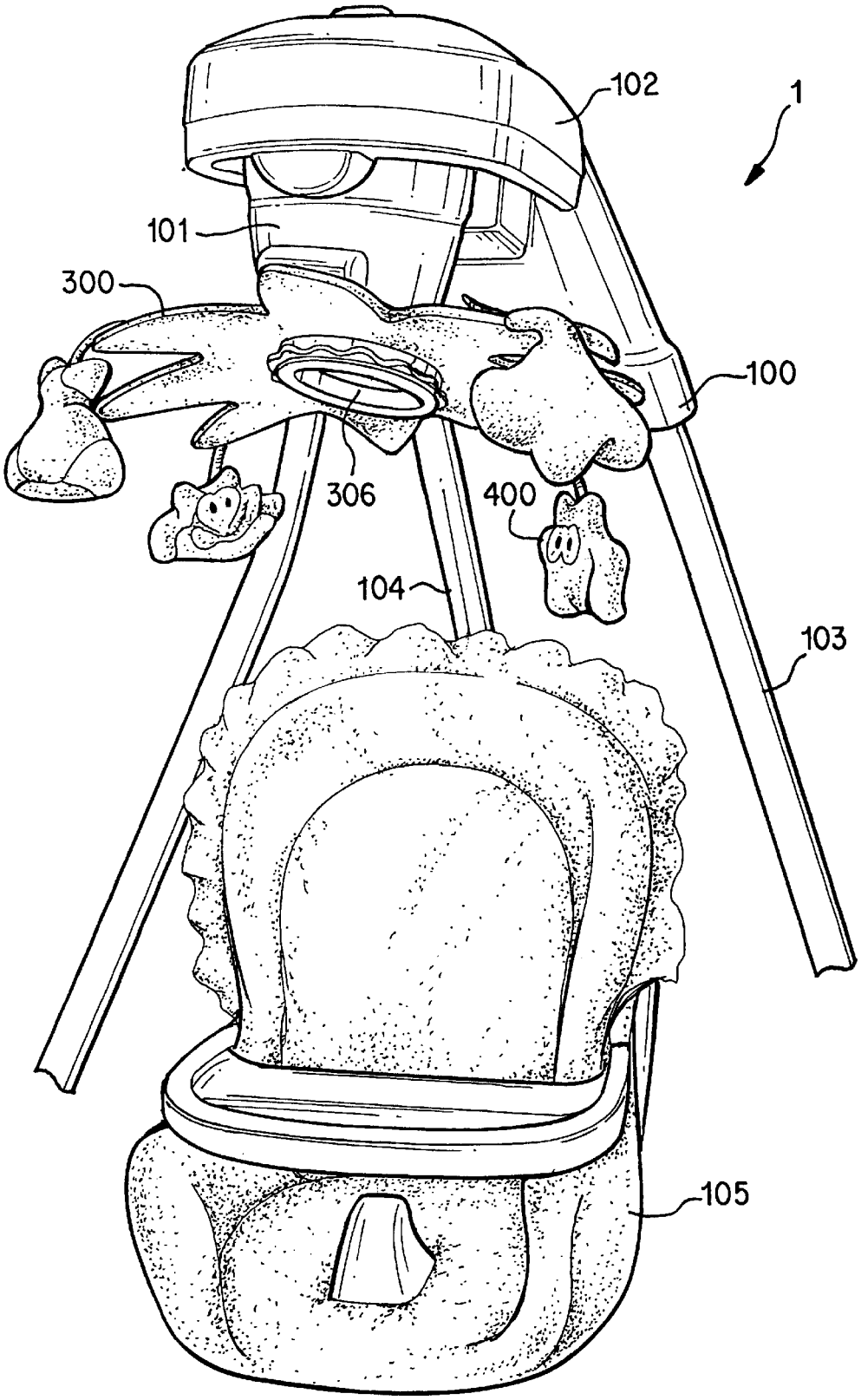
FIG. 1*a* is a front elevation view of an entertainment device made in accordance with an embodiment of the invention.

FIG. 1*a* shows an entertainment device 1 including an entertainment member 300 formed as a mobile and a child support device 100 formed as a child swing. The child support device 100 can be formed as a cradle swing, such as those shown in U.S. Pat. Nos. 5,803,817 and 6,027,409, which are incorporated by reference herein in their entirety. The child support device 100 preferably includes support members 103 that support an upper housing 102, swing arm 104 and swing seat 105. The upper housing 102 can include a driving device that provides motion to the swing arm 104 and swing seat 105. An upper structure 101 of the upper housing 102 includes a surface from which the entertainment member 300 may be attached to the child support device 100. The entertainment member 300 may be a freely rotatable soft mobile that is located within reach of a child located in the swing seat 105. Several hanging structures 400 (e.g., soft toys) can be attached to the entertainment member 300 to entertain a child located in the swing seat 105.

Figure 1B:
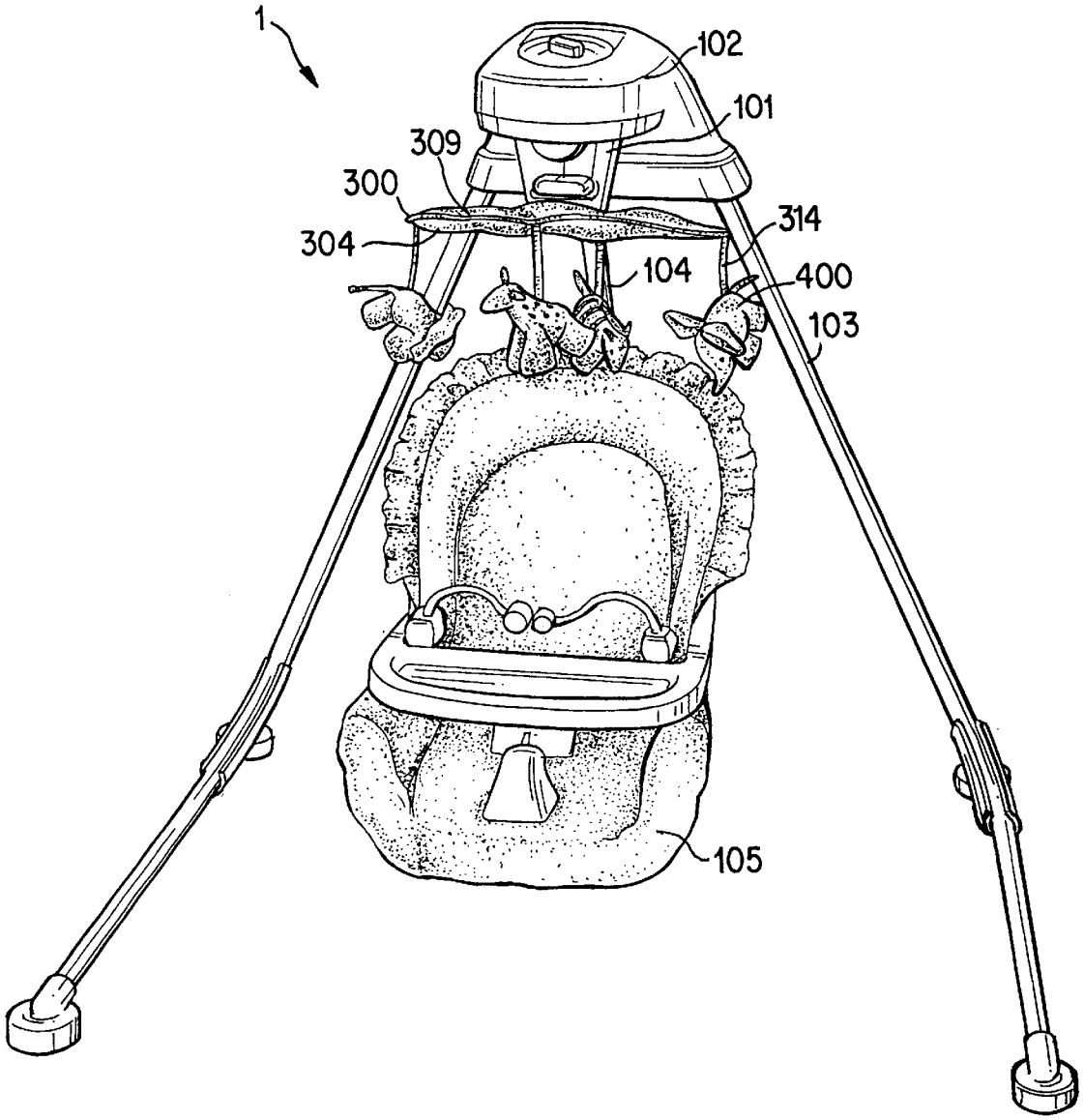
FIG. 1*b* is a front elevation view of an entertainment device made in accordance with another embodiment of the invention.

FIG. 1*b* shows another preferred embodiment of the invention. The entertainment device 1 includes an entertainment member 300 that is covered with a soft goods padding 309 and includes hanging structures 400 that are attached directly to the soft goods padding 309 by fabric strips 314.

Figure 2:
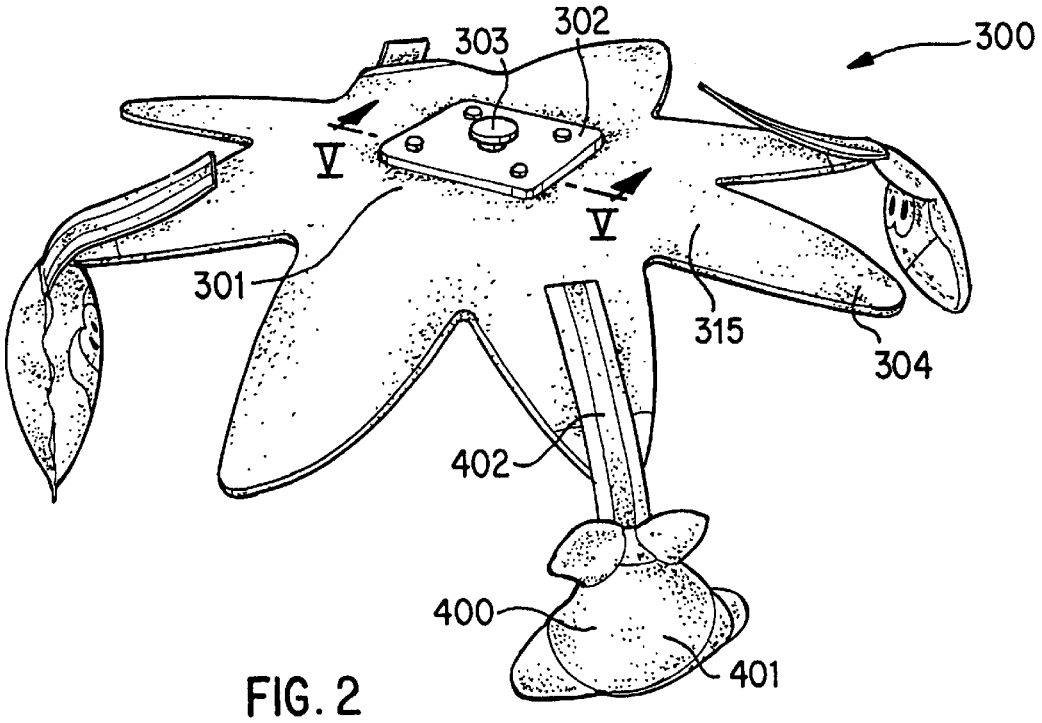
FIG. 2 is a top perspective view of the entertainment member including the connector structure and attached soft toys of the entertainment device as shown in FIG. 1*a*.

FIG. 2, is a top perspective view of the entertainment member 300 of FIG. 1*a*. The entertainment member 300 can include a connector structure 302 located at a center of rotation of the body portion 315 of the entertainment member 300. A plurality of hanging structures 400 formed as soft toys 401 can be releasably attached to entertainment members 304 located around the periphery of the body portion 315. The soft toys 401 can be attached to a piece of Velcro® 402 that can be mated with a corresponding piece of Velcro® 403 attached to the end of an entertainment member finger 304. The distance between the end of the entertainment member finger 304 and each soft toy 401 can be adjusted by attaching the Velcro® 403 at different locations along the Velcro® piece 402. Although this distance may vary, the entertainment member 300 maintains a low profile in comparison to conventional mobiles. An entertainment member palm area 301 and a connector structure 302 can be located at a center of the plurality of entertainment member fingers 304. The connector structure 302 preferably includes a buttonlike protuberance 303 that allows the entertainment member 300 to rotate freely within a receiving member 200 secured to the child support device 100.

Figure 3:
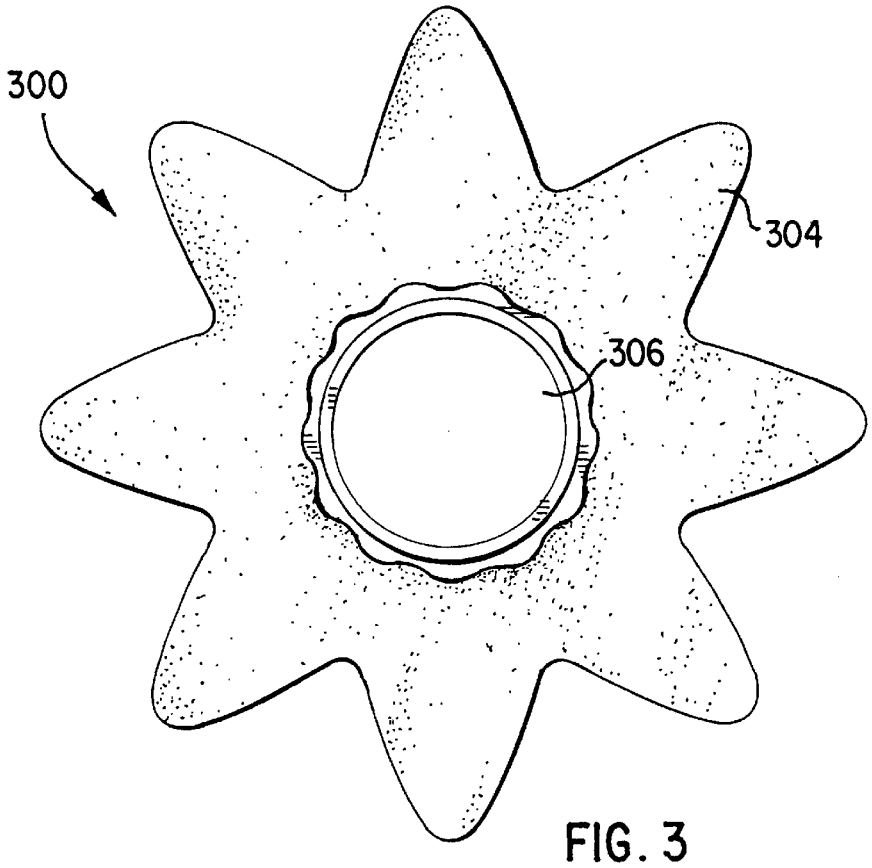
FIG. 3 is a bottom perspective view of the entertainment member of the entertainment device as shown in FIG. 1*a*.

FIG. 3 is a perspective bottom view of the entertainment member 300 of FIG. 1*a*. A variety of entertainment structures, such as reflective surface 306, can be attached to the underside of the entertainment member 300 to further stimulate a child located on the entertainment device.

Figure 4:
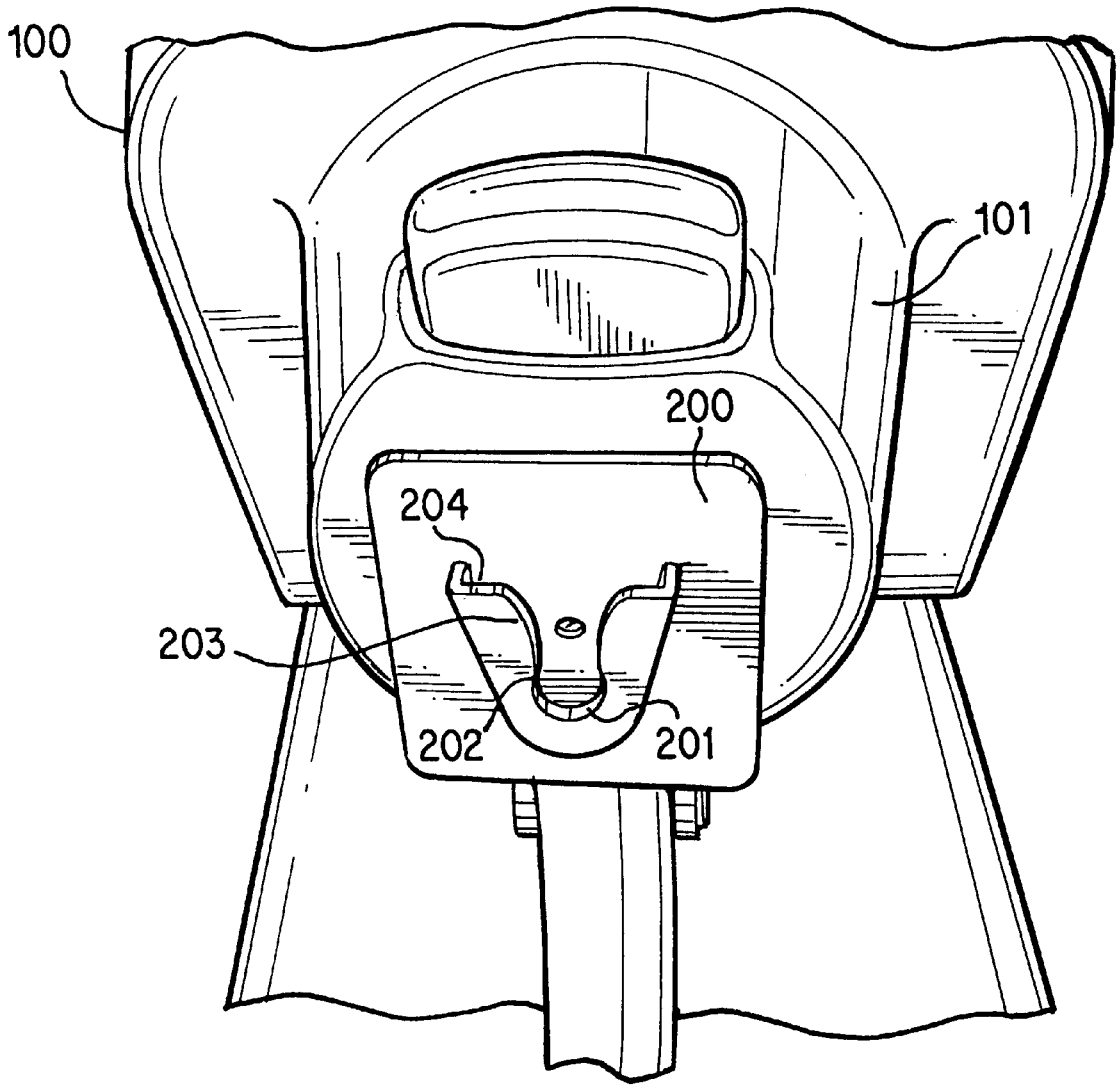
FIG. 4 is a perspective view of the upper structure and receiving member of the entertainment device as shown in FIG. 1*a*.

FIG. 4 shows the receiving member 200, which can be attached to the upper structure 101 of the child support device 100. The receiving member 200 preferably has a U-shaped slot aperture 204 that has a width and thickness slightly greater than the button-like protuberance 303 of the connector structure 302. The button-like protuberance 303 may be slid into or out of the U-shaped slot aperture 204 with relative ease. The receiving member can include guiding ramp surfaces 203 and restrictive ramp surfaces 202. The guiding ramp surfaces 203 are spaced from each other at a distance that is slightly larger than the outer diameter of the shaft 305 of connector structure 302. The restrictive ramp surfaces 202 are spaced from each other at a distance that is slightly smaller than the outer diameter of the shaft 305 of connector structure 302. Thus, upon entry of the button-like protuberance 303 into the U-shaped aperture slot, the guiding ramp surfaces 203 guide the shaft 305 of the connector structure 302 towards the fixed hole 201. In addition, upon application of a predetermined amount of force, the restrictive ramp surfaces 202 flex to allow passage and guide the connector structure 302 into the fixed hole 201. Once the connector structure 302 is located in the fixed hole 201, the restrictive ramp surfaces 202 return to their original position to effectively lock the connector structure 302 at a predetermined position within the U-shaped slot 204 of the receiving member 200. The fixed hole 201 can be slightly larger than the outer diameter of the connector member shaft 305 such that the connector structure 302 (and entertainment member 300) can rotate with respect to the receiving member 200.

Figure 5:
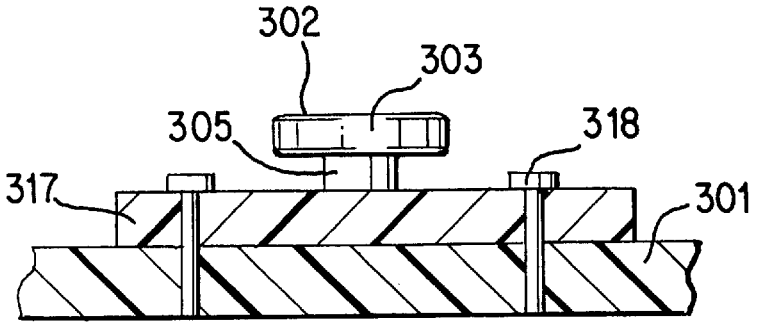
FIG. 5. is a cross-section view of the connector structure including the button-like protuberance and shaft of the entertainment member taken along line V—V of FIG. 2.

FIG. 5 shows a partial cross-sectional side view of the entertainment member taken along line V—V of FIG. 2. The connector structure 302 can include a button-like protuberance 303 and shaft 305 that are integral with an attachment plate 317. The attachment plate 317 can be secured to the palm portion 301 of the entertainment member 300 by connectors 318, such as rivets, screws, welds, etc. The button-like protuberance 303 is sized such that it can rotate freely within the U-shaped aperture 204 of the receiving member 200 when the shaft 305 is secured in the fixed hole 201.

Figure 6:
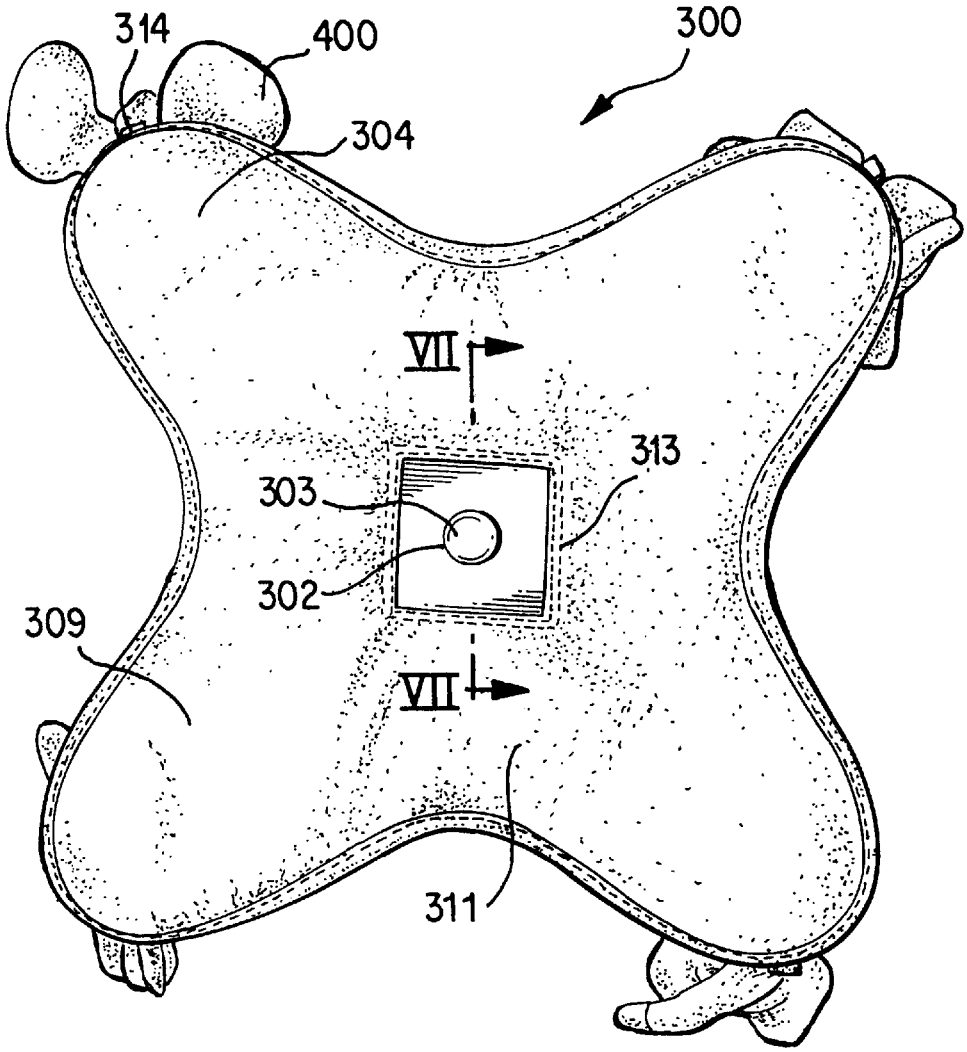
FIG. 6 is a top view of the entertainment member including the connector structure and attached soft toys of the entertainment device as shown in FIG. 1*b*.

FIG. 6 is a top view of the entertainment member 300 as shown in FIG. 1*b*. The entertainment member 300 can include four fingers 304 that each has a hanging structure 400 attached thereto by a strip of fabric 314. The soft goods 309 can include a fabric cover 311 that is connected to the entertainment member 300 by stitching 313. The connector 302 can be formed as a button-like protuberance 303 and located at a center of rotation of the entertainment member 300.

Figure 7:
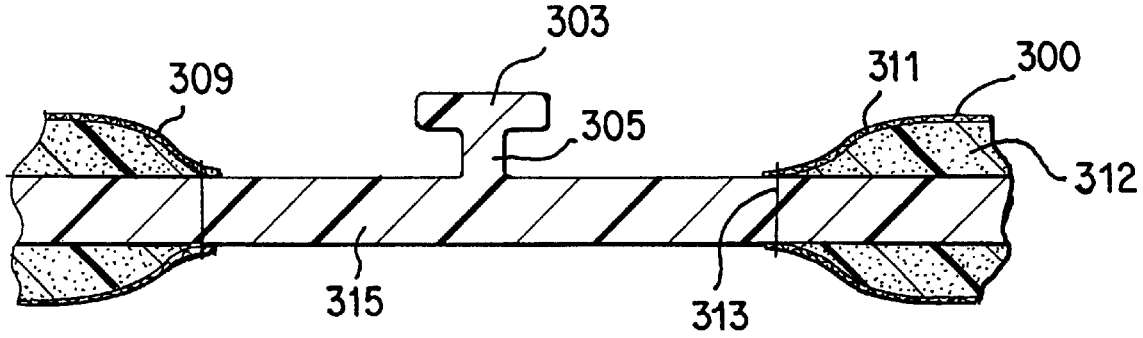
FIG. 7 is a cross section view taken along line VII—VII of FIG. 6.

FIG. 7 shows a partial cross-section side view of the entertainment member 300 taken along line VII—VII of FIG. 6. The connector structure 302 can include a button-like protuberance 303 and shaft 305 that are integral with the body 315 of the entertainment member 300. The soft goods padding 309 can include a fabric cover 311 containing a soft cushion material 312 and can be attached to the body 315 by stitching 313 or other attachment means, such as glue, fasteners, etc.

In operation, a user can quickly and repeatably attach and remove the entertainment member 300 to and from the child support device 100 by inserting and "snapping" the connector structure 302 into the receiving member 200 and removing and "un-snapping" the connector structure 302 from the receiving member 200. As the shaft 305 of the connector structure 302 passes the guide ramp surfaces 203, it pushes apart the restrictive ramp surfaces 202 far enough for the shaft 305 to pass into the wider fixed hole 201. Once the shaft 305 is located within the fixed hole 201, the restrictive ramp surfaces 202 return to their normal shape to hold the shaft 305 in the fixed hole 201. The guide ramp surfaces 203 and the restrictive ramp surfaces 202 are preferably made of a flexible material that allows the restrictive ramp surfaces 202 to deflect and the shaft 305 to snap easily into place. Once in the fixed hole 201, the shaft 305 and the buttonlike protuberance 303 can freely spin at a predetermined position with respect to the receiving member 200.

The position of the hanging structures 400 relative to the seated child may be adjusted by attaching the Velcro® pieces 402 at different positions along Velcro® 403. The entertainment member 300 is then available to be enjoyed by the child as it sits or swings in the child support device.

The entertainment member is also easily detached from the child support device. When the entertainment member 300 is snapped-out of the fixed hole 201, the flexible restrictive ramp surfaces 202 deflect far enough for the shaft 305 to pass the restrictive and guide ramp surfaces, 202 and 203, respectively. The entertainment member 300 can then be set aside so that the user can remove the child from the child support device 100.

Various modifications of the entertainment devices 1 shown in FIGS. 1*a*–7 can be made without departing from the spirit and scope of the invention. For example, the eight-point star shaped freely rotatable soft mobile shown in FIG. 2 is just one embodiment of the entertainment member 300 of the invention. Numerous other shapes, sizes, colors, and patterns are contemplated that fall within the scope of the present invention. For example, the entertainment member may include a propeller shaped mobile with different colors and patterns displayed on each blade. Aviation motif soft toys could also be provided for hanging from each of the blades.

The entertainment member 300 can also be constructed of various flexible but sufficiently stiff materials, such as plastics, polyurethane foam, wood, metal, etc.

The hanging entertainment structures 401 may be attached at various locations on the entertainment member 300, including the periphery, the central portion, and at varied locations on the rotary entertainment member 300. It is also envisioned that the hanging entertainment structures 401 include soft toys that a child can grasp, pull down, and bite. Thus, the soft toys may facilitate teething as well as entertain and amuse. In other embodiments of the invention, the hanging entertainment structures may be attached to the rotary entertainment structure by structures other than Velcro®, such as looped cloth pieces that close together at their ends, strings, buttons or other structures.

The means for connecting the rotary entertainment structure to the connection structure may be made of a plastic or other flexible material that allows for both components to rotate freely with respect to one another. In a preferred embodiment, the means for connecting includes a button-like structure 303 which mates with a receiving member 200 including a U-shaped slot aperture 204. The position of the button like structure 303 and U-shaped slot aperture 204 can be reversed by mounting the button like structure 303 to the upper structure 101 of the child support device 100 and locating the U-shaped slot aperture 204 on the entertainment member 300. In yet another alternative, the means for connecting can be configured as a detachable ball that rotates in a socket. This arrangement precludes the unintended translation of the ball from the socket while allowing the entertainment member 300 to rotate freely. In addition, ball bearings or other structures or materials can be provided to facilitate rotation of the entertainment member 300.

Various modifications can be made, if necessary, to the child support device in order to incorporate the invention. For example, an attachment bar can be suspended over a child's cradle, bassinet, swing, bouncer, car seat, or other child support to attach the entertainment member, e.g., mobile, etc.

The location of the entertainment member can be above a child in the child's support device. However, it is contemplated that the entertainment member is located in a vertical or other orientation/location relative to the child support device. In addition, the entertainment member can be located below the child when the child is located within the child support device.

It will be apparent to those skilled in the art that various modifications and variations can be made to the releasable and securable entertainment device without departing from the spirit or scope of the invention. Thus, it is intended that the present invention cover the modifications and variations of this invention provided they come within the scope of the appended claims and their equivalents.

What is claimed is:

1. An entertainment device, comprising:

an entertainment member including a connector structure; and a receiving member releasably securable with said connector structure of said entertainment member and configured such that when said connector structure is secured to said receiving member, said receiving member prevents translation of said connector structure while allowing rotation of said connector structure relative to said receiving member;

wherein said receiving member includes a U-shaped slot and said connector structure is a button shaped connector, such that said button shaped connector can be frictionally secured within said U-shaped slot while also rotatable with respect to said U-shaped slot.

2. The entertainment device of claim 1, wherein said U-shaped slot has an outer slot portion that is slightly narrower than an outer cross-sectional width of said button shaped connector such that said button shaped connector can be snapped into said U-shaped slot to secure said button shaped connector at a predetermined position within said U-shaped slot while permitting said button shaped connector to rotate with respect to said U-shaped slot.

3. The entertainment device of claim 2, further comprising:

a child support attached to said receiving member such that a child can be placed in a vicinity of said entertainment member when said connector structure of said entertainment member is secured to said receiving member, wherein said child support includes a child swing and an upper structure located above said child swing, said receiving member being located on said upper structure such that said entertainment member is located above said child swing when said connector structure is secured to said receiving member.

4. An entertainment device, comprising:

a rotary entertainment member; and means for connecting said rotary entertainment member to another structure such that said rotary entertainment member is prevented from translating with respect to said other structure, can freely rotate relative to said other structure and can be selectively removable from said other structure.

5. The entertainment device of claim 4, wherein said rotary entertainment member includes a mobile with hanging entertainment structures.

6. The entertainment device of claim 4, wherein said means for connecting includes a button shaped structure located at a center of rotation of said rotary entertainment member.

7. The entertainment device of claim 6, wherein said means for connecting further includes a U-shaped slot that is configured to permit said button shaped structure to slide into said U-shaped slot.

8. The entertainment device of claim 7, wherein said U-shaped slot has surfaces that are spaced from each other a distance that is slightly narrower than an outer cross-sectional width of a shaft portion of said button shaped structure such that said button shaped structure can be snapped into said U-shaped slot to secure said button shaped structure within said U-shaped slot at a predetermined position while permitting said button shaped structure to rotate with respect to said U-shaped slot at said predetermined position.

9. The entertainment device of claim 4, further comprising:

a child support attached to said means for connecting and configured such that a child can be placed in a vicinity of said entertainment member.

10. The entertainment device of claim 9, wherein said child support includes a child swing and an upper structure located above said child swing, said means for connecting being located at said upper structure such that said entertainment member is located above said child swing when said entertainment member is connected to said child support by the means for connecting.

11. The entertainment member of claim 4, wherein said means for connecting includes flexible portions for selectively removing said rotary entertainment member from said other structure by pushing apart said flexible portions.

12. The entertainment member of claim 11, wherein said means for connecting further includes a protuberance disposed on one of said rotary entertainment member and said other structure and said protuberance is selectively removable from the other of said rotary entertainment member and said other structure by pushing apart said flexible portions with said protuberance.

13. The entertainment member of claim 12, wherein said protuberance is integrally formed on said rotary entertainment member.

14. The entertainment member of claim 13, wherein said protuberance includes one of a button-like protuberance and ball and said other structure includes one of a U-shaped slot and socket wherein each of said U-shaped slot and socket comprises said flexible portions and said one of a button-like protuberance and ball is selectively removable from the respective one of said U-shaped slot and socket.

15. The entertainment member of claim 14, wherein said other structure is one of a swing, cradle, bassinet, bouncer and car seat.

16. The entertainment member of claim 15, wherein said first portion is disposable above said swing seat.

17. The entertainment member of claim 4, wherein said means for connecting includes a ball that is detachably securable in a socket.

18. The entertainment member of claim 17, wherein one of said first portion and said second portion includes flexible portions for receiving the other of said first portion and said second portion wherein said rotary entertainment member is selectively removable from said first portion by flexing of said flexible portions.

19. The entertainment member of claim 18, wherein said rotary entertainment member is a mobile.

20. The entertainment member of claim 4, wherein said other structure is a swing comprising a frame, a swing arm having an upper portion and a lower portion, the swing arm being rotatably coupled to said frame at its upper portion, and a seat coupled to said swing arm lower portion, wherein said means for connecting said rotary structure to said swing includes a first portion that is securable to one of said frame, said seat and said swing arm, and a second portion that is adapted for selectively removing said rotary entertainment member to said first portion.

21. The entertainment member of claim 20, wherein said first portion is an attachment bar that is positionable above said swing seat.

22. The entertainment member of claim 21, wherein said means for connecting includes a socket formed on one of said attachment arm and said rotary entertainment member and a ball formed on the other of said attachment arm and said rotary entertainment member.

23. The entertainment member of claim 20, wherein said first portion is securable to said swing arm.

24. A method for connecting a rotary entertainment member to another structure, comprising:

providing a rotary entertainment member having a connector located at a point of rotation of said rotary entertainment member;

providing a connection structure; and securing said connector to said connection structure by securing said connector at a predetermined position with respect to said connection structure while permitting said connector to freely rotate with respect to said connection structure;

wherein said connector includes a button shaped protrusion and said connection structure includes a U-shaped slot, said step of securing includes inserting said button shaped protrusion into said U-shaped slot.

25. The method for connecting a rotary entertainment member of claim 17, wherein said U-shaped slot has an outer insertion width portion that is narrower than a width of said button shaped protrusion, such that said step of inserting said button shaped protrusion into said U-shaped slot includes moving said button shaped protrusion through said outer insertion width portion of said U-shaped slot until said button shaped protrusion passes said outer insertion width portion of said U-shaped slot and said button shaped protrusion can freely rotate while located in said U-shaped slot.

26. A method for connecting a rotary entertainment member to another structure, comprising:

providing a rotary entertainment member having a connector located at a point of rotation of said rotary entertainment member;

providing a connection structure;

securing said connector to said connection structure by securing said connector at a predetermined position with respect to said connection structure while permitting said connector to freely rotate with respect to said connection structure;

providing a child support attached to said connection structure such that a child can be placed in a vicinity of said rotary entertainment member;

wherein said child support includes a child swing and an upper structure located-above said child swing, said connection structure being located on said upper structure such that said rotary entertainment member is located above said child swing when said connector is secured to said connection structure wherein said step of securing said connector to said connection structure includes the step of sliding said connector into said connection structure while overcoming a frictional resistance wherein said frictional resistance is the sole means securing said connector in said connection structure at said predetermined position.

27. A combination entertainment device and child support, comprising:

a frame including right and left frame portions;

a support structure rotatably coupled to the frame and including at least one generally C-shaped swing arm having an upper portion and a lower portion;

a seat coupled to the lower portion; and a connector assembly for disposing the entertainment device above the seat and approximately equidistant from the left and right frame portions so as to provide a child placed in the seat with access to the entertainment device, the connector assembly including:

a coupler disposed on the entertainment device, the coupler including a lower member, a laterally extending upper protrusion, and a vertically extending shaft disposed between the protrusion and lower member, a mount adapted for mating with the coupler and defining a generally ushaped slot including a guiding portion for releasably receiving the shaft, and a restrictive portion retaining the coupler in the generally u-shaped slot and allowing the entertainment device to freely rotate about the mount, wherein the entertainment device is releasably secured to the mount by forcibly pressing the shaft past the guiding portion and into the restrictive portion, thereby retaining the coupler within the restrictive portion.

28. The combination entertainment device and child support of claim 27, wherein the protrusion is a button-like protrusion and the restrictive portion defines guiding ramp surfaces.

29. The combination entertainment device and child support of claim 27, wherein the protrusion generally describes a ball and the restrictive portion generally describes a socket.

30. The combination entertainment device and child support of claim 27, wherein the mount is coupled to the support structure.

31. A combination child swing and entertainment device, comprising:

a stationary frame including a left and right frame portion;

a seat;

a support structure having an upper portion rotatably coupling the support structure to the frame, and a lower portion coupled to the seat;

a mount disposed on the upper portion and including a first connector securing the entertainment device to the mount such that the entertainment device may freely rotate about the mount;

wherein the entertainment device is disposed above the seat and approximately equidistant from the left and right frame portions so as to provide an infant placed in the seat with access to the entertainment device.

32. The combination child swing and entertainment device of claim 31, wherein the mount is fixed relative to the seat.

33. The combination child swing and entertainment device of claim 31, wherein the support structure includes at least one generally C-shaped swing arm having first and second portions corresponding to the support structure upper and lower portions, respectively.

34. The combination child swing and entertainment device of claim 31, wherein the first connector comprises a u-shaped slot and the entertainment device includes a button-like protrusion releasably secured in the slot.

35. The combination child swing and entertainment device of claim 31, wherein the first connector comprises a socket and the entertainment device includes a ball received in the socket.

36. The combination child swing and entertainment device of claim 31, further including an attachment arm having a first end and a second end, wherein the mount is disposed on the second end and the attachment arm is coupled to the swing arm at the first end.

* * * * *

UNITED STATES PATENT AND TRADEMARK OFFICE

CERTIFICATE OF CORRECTION

PATENT NO. : 6,464,594 B1
DATED : October 15, 2002
INVENTOR(S) : John Canna et al.

It is certified that error appears in the above-identified patent and that said Letters Patent is hereby corrected as shown below:

Title page,
Item [75], Inventor's Address: "South Whales" should be -- South Wales --;

Column 8,
Line 32, "claim 17" should be -- claim 24 --; and

Column 9,
Line 19, "ushaped" should be -- u-shaped --.

Signed and Sealed this

First Day of April, 2003

JAMES E. ROGAN
*Director of the United States Patent and Trademark Office*